US012698687B2

(12) United States Patent
Rashid et al.

(10) Patent No.: US 12,698,687 B2
(45) **Date of Patent: *Aug. 4, 2026**

(54) TWO-STAGE MULTI-OBJECTIVE OPTIMIZATION SCHEME FOR WELLBORE CLEANUP WITH AN EMISSIONS MEASURE

(71) Applicant: Schlumberger Technology Corporation, Sugar Land, TX (US)

(72) Inventors: Kashif Rashid, Wayland, MA (US); William Bailey, Somerville, MA (US); Glen Andrew Hay, Calgary (CA); Bertrand Theuveny, Paris (FR); Morten Kristensen, Lysaker (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/269,326

(22) Filed: Jul. 15, 2025

(65) Prior Publication Data

US 2025/0341139 A1 Nov. 6, 2025

Related U.S. Application Data

(62) Division of application No. 18/333,342, filed on Jun. 12, 2023, now Pat. No. 12,359,516.

(51) Int. Cl.
*E21B 37/00* (2006.01)
*E21B 21/08* (2006.01)

(52) U.S. Cl.
CPC ..... *E21B 21/08* (2013.01); *E21B 2200/02* (2020.05); *E21B 2200/20* (2020.05); *E21B 2200/22* (2020.05)

(58) Field of Classification Search
CPC ..... E21B 2200/20; E21B 2200/22
See application file for complete search history.

(56) References Cited

U.S. PATENT DOCUMENTS

| | | | | |
|---|---|---|---|---|
| 6,629,222 | B1 | 9/2003 | Jeddeloh | |
| 10,352,162 | B2 * | 7/2019 | Kristensen | E21B 49/10 |
| 12,359,516 | B2 * | 7/2025 | Rashid | E21B 21/08 |
| 2008/0133194 | A1 | 6/2008 | Klumpen | |
| 2010/0274546 | A1 * | 10/2010 | Zafari | E21B 37/00 166/311 |
| 2012/0160011 | A1 | 6/2012 | Whittaker | |
| 2013/0240210 | A1 | 9/2013 | Yale | |
| 2017/0220050 | A1 | 8/2017 | Popa | |
| 2018/0004234 | A1 | 1/2018 | Dursun | |
| 2022/0316321 | A1 | 10/2022 | Gagliano | |

(Continued)

FOREIGN PATENT DOCUMENTS

WO 2025174828 A1 8/2025

OTHER PUBLICATIONS

Al-Safran, E. et al., "High-Viscosity Liquid/Gas Flow Pattern Transitions in Upward Vertical Pipe Flow", SPE Journal, 2020, 19 pages.

*Primary Examiner* — Kenneth L Thompson
(74) *Attorney, Agent, or Firm* — Jeffrey D. Frantz

(57) ABSTRACT

Embodiments presented provide for a method for calculation of an optimal scheme for wellbore cleanup. In embodiments, an emissions measure is used to minimize environmental impact from wellbore cleanup activities while establishing the most efficient steps and techniques to be performed during the cleanup activities.

12 Claims, 6 Drawing Sheets

(56) References Cited

U.S. PATENT DOCUMENTS

| | | | | |
|---|---|---|---|---|
| 2023/0020417 | A1 | 1/2023 | ElBsat | |
| 2024/0411951 | A1* | 12/2024 | Rashid | G06F 30/20 |
| 2025/0067146 | A1* | 2/2025 | Theuveny | E21B 21/08 |
| 2025/0067147 | A1* | 2/2025 | Theuveny | E21B 47/26 |
| 2025/0163777 | A1* | 5/2025 | Theuveny | E21B 37/00 |
| 2025/0264005 | A1* | 8/2025 | Theuveny | E21B 47/00 |

* cited by examiner

| | | | |
|---|---|---|---|
| R (pct) | 98.928 | 98.93 | |
| T (hrs) | 28.4 | 28.4 | |
| E (Kkg) | 112.85 | 210.81 | 97.97 |
| V3 | 26.676 | 24.770 | -1.909 |
| GRfeas | 1 | 1 | |
| CumOil | 544 | 1,035 | 491 |
| CumGas | 54,566 | 103,714 | 49,148 |
| CumWater | 0.99 | 1.22 | 0.23 |
| OilRate (max) | 1,184 | 1,385 | 201 |
| GasRate (max) | 118,426 | 144,849 | 26,423 |
| WatRate (max) | 4.93 | 4.93 | |
| WHP (min) | 6.32 | 6.32 | |
| WHP (max) | 19895.97 | 19893.80 | -2.17 |

FIG. 2

$R_m = f(R)$ $R \sim [R_{min}\ R_{max}]$ $T_m = f(T)$ $T \sim [T_{min}\ T_{max}]$ $E_m = f(E)$ $E \sim [E_{min}\ E_{max}]$ V1 - Absolute Priority on Clean-up $$V_1 = R + \frac{R}{T_{mins}} \qquad \bar{V}_1 = V_1 + \frac{V_1}{E} \quad \text{if } E > 0$$

V2 - Linear Sum of Weighted Measures $$V_2 = w_r R_m(R) + w_t T_m(T) + w_e E_m(E)$$

V3 - Exponential Weighted Sum $$V_3 = 10e^{0.01U} - 10 \quad \text{where } U = w_r R_m(R) + w_t T_m(T) + w_e E_m(E)$$

V4 - Distance from Maximal Vertex $$V_4 = \|P, P_{max}\| \quad \text{where } P = [R_m \;\; T_m \;\; E_m]$$

$$\text{and } P_{max} = [10 \;\; 10 \;\; 10]$$

FIG. 6

TWO-STAGE MULTI-OBJECTIVE OPTIMIZATION SCHEME FOR WELLBORE CLEANUP WITH AN EMISSIONS MEASURE

CROSS-REFERENCE TO RELATED APPLICATIONS

This application is a divisional of U.S. patent application Ser. No. 18/333,342, filed on Jun. 12, 2023, which is incorporated herein by reference in its entirety. All subject matter disclosed in the parent application is hereby included in this divisional application to the extent permissible by applicable law.

FIELD OF THE DISCLOSURE

Aspects of the disclosure relate to wellbore cleanup technologies. More specifically, aspects of the disclosure relate to a method to allow for wellbore cleanup that uses metrics of importance to a user. In embodiments, a two stage multi-objective optimization scheme is used for wellbore cleanup with an emissions measure.

BACKGROUND

Wellbore cleanup activities are an essential part of hydrocarbon recovery operations. Wellbore cleanup activities provide for removal of fluids and or other materials from a wellbore. The overall objective of these activities is to provide a wellbore clear of contaminants so further processing may occur. Wellbore cleanup activities can include pumping materials from the wellbore, in one example embodiment. Other cleanup activities may include dislodging materials that may be stuck on the sides of the wellbore that may interfere with flow from the wellbore.

Conventionally, hydrocarbon operators merely try to pump materials from the wellbore. In other types of techniques, downhole tools, such as reamers, may be used for cleaning. As will be understood, reamers use rotating technology to dislodge materials. Most conventional technology; however, use pumps to remove materials from the wellbore.

While conventional technology may provide some benefits for removing materials, conventional technologies lack a key component in the evolving needs of society. Conventional technologies never take into account emissions and environmental contamination that are produced during operations. Often, local and national permits are issued to operators where environmental limits are placed on produced contaminants. As hydrocarbon recovery activities can be energy intensive, emissions from such activities may be problematic for local communities. Conventional technologies never plan out activities on a local basis to find out which method steps should be accomplished in order to achieve efficient operations and minimal environmental impact. Conventional operators merely run equipment at maximum speed to accelerate completion of the project with no regard to emissions. If an equally effective method of optimized wellbore cleanup is present without the emissions, it is ignored.

Ultimately, ignoring the environmental ramifications on wellbore cleanup activities can lead to job stoppage and increased costs. For example, if operators ignore the environmental concerns up until a threshold value of the permits required for the site, the job is either stopped for a period of time to bring the activities back into compliance, or the job operator is required to pay a fine for exceeding environmental standards.

There is a need to provide for an optimization scheme for wellbore cleanup that provides for efficient wellbore cleanup.

There is a need to provide an apparatus and methods that easier to operate than conventional apparatus and methods but provide for efficient overall results.

There is a further need to provide apparatus and methods that do not have the drawbacks discussed above, namely inadvertent or intentional exceedance of environmental pollution standards.

There is a still further need to reduce economic costs associated with operations and apparatus described above with conventional tools such that projects are not stopped because of permit limitations.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a method is disclosed. The method may comprise designing an arrangement for cleanup of a wellbore. The method may further comprise placing data pertaining to the arrangement for cleanup of the wellbore into a simulator designed to determine a simulator output for the arrangement. The method may further comprise feeding the simulator output for the arrangement into both an emissions engine and a cleanup evaluator to achieve an emissions engine output and a cleanup evaluator output. The method may further comprise inputting the cleanup evaluator output and the emissions engine output into an aggregator to achieve an aggregated solution. The method may further comprise optimizing the aggregated solution to achieve optimized results. The method may further comprise performing the method repetitively for all times related to a choke schedule.

In another example embodiment, an article of manufacture having a non-volatile memory configured to receive and store a set of instructions to be performed on a computing device, the set of instructions including a method comprised of designing an arrangement for cleanup of a wellbore. The method performed may also comprise placing data pertaining to the arrangement for cleanup of the wellbore into a simulator designed to determine a simulator output for the arrangement. The method performed may also comprise feeding the simulator output for the arrangement into both an emissions engine and a cleanup evaluator to achieve an emissions engine output and a cleanup evaluator output. The method performed may also comprise inputting the cleanup evaluator output and the emissions engine output into an aggregator to achieve an aggregated solution. The method performed may also comprise optimizing the aggregated solution to achieve optimized results. The method performed may also comprise performing the method repetitively for all times related to a choke schedule.

In another example embodiment, a method for optimizing a cleanup of a wellbore is disclosed. The method may also comprise designing a mechanical arrangement configured to perform the cleanup of the wellbore, the mechanical arrangement having performance data. The method may also comprise placing the performance data pertaining to the arrangement for the cleanup of the wellbore into a simulator and determining a simulator output for the arrangement. The method may also comprise feeding the simulator output for the arrangement into both an emissions engine and a cleanup evaluator to achieve an emissions engine output and a cleanup evaluator output. The method may also comprise inputting the cleanup evaluator output and the emissions engine output into an aggregator to achieve an aggregated solution. The method may also comprise optimizing the aggregated solution through use of a radial basis function to achieve optimized results. The method may also comprise performing the method repetitively for all times related to a choke schedule as well as for different mechanical arrangements, wherein the choke schedule is determined for safe operations at the wellhead and in the wellbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

FIG. 2 is a table of calculations for a two-stage scheme for wellbore cleanup in one example embodiment of the disclosure.

FIG. 6 FIG. 6 shows example values of different metrics used for calculation purposes.

Figure 1:
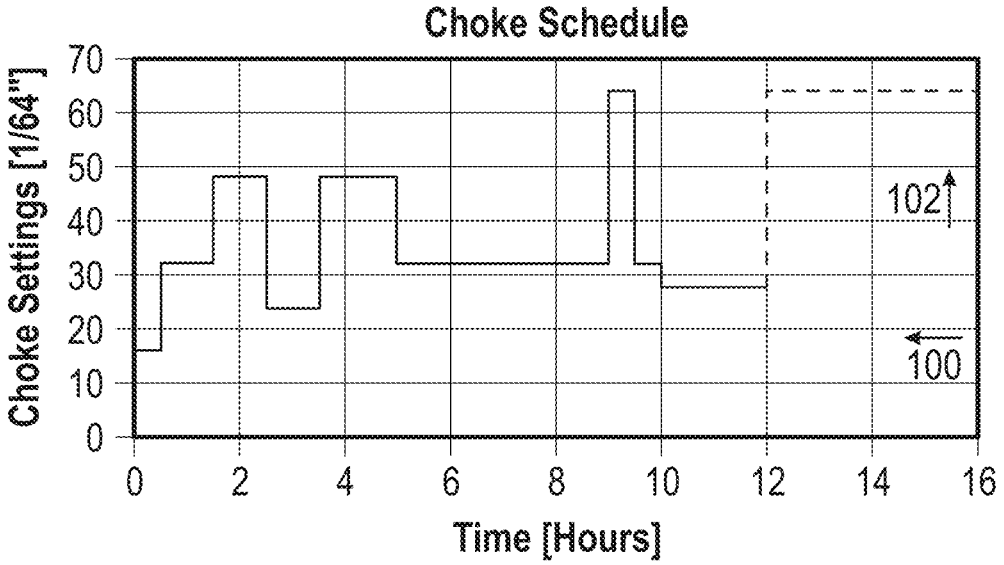
FIG. 1 is an example of a choke schedule showing a choke setting variation over time.

To facilitate understanding, identical reference numerals have been used, where possible, to designate identical elements that are common to the figures ("FIGS."). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Aspects of the disclosure concern an optimization method for wellbore cleanup. In embodiments, a two-stage solution procedure is used for wellbore clean-up optimization with an emissions measure. As will be understood, in embodiments, optimization may be done for a variety of factors, such as emissions, energy use, time or other value. In aspects of the disclosure, elimination of undesirable fluids and materials from a wellbore (based on a simulator) is performed. Aspects of the differentiation between the systems used for elimination of the fluids and materials may be the time that is used to accomplish the objective. Thus, an iterative process may be performed wherein a first system is designed to accomplish the main objective and a time is recorded for each system as well as an emission measure. Then, a different system may be chosen/designed and the time and emissions calculated. For convenience of explanation, the $CO_2$ emissions are calculated by a SYMMETRY simulator. A choke schedule may be used, as defined by operators, to ensure that wellbore defects do not occur during the cleanup activities.

As can be seen from the above, a multi-objective problem is solved that allows for a maximization of cleanup capability with the lowest possible emissions. As will be understood, the SYMMETRY simulator may calculate $CO_2$ emissions wherein clean-up values are maximized while minimizing the time required to do so. Differing schedules to prevent well cave in may be used wherein emissions ensuing from the surface choke schedule implemented as a design variable. Although discussed as pertaining to $CO_2$ emissions, a person of ordinary skill in the art will understand that other contaminants may be chosen, thus the disclosure should not be considered limiting.

The present aspects of the disclosure provides a comprehensive design strategy that operators may use in planning a project. As will be understood, one project may be designed or several projects in the same area may be designed. Differing value calculations may be performed. In one non-limiting embodiment, the value for clean-up estimation is defined as quantity R. The overall time required for completion of the task is defined as quantity T. The process uses the cleanup engine simulator (CUCP engine) as the forward near-wellbore simulator to model the behavior of fluid flow through the wellbore as a function of a choke schedule.

For definition, a choke schedule is defined as the variation of a choke setting over time. Research has found that bringing a wellbore up to production too fast may significantly compromise viability of the well. In some instances, the amount of potential economic return is minimized. In far worse situations, a complete failure of the wellbore may occur. To make sure that such dire consequences do not occur, operators employ a "choke schedule" where production is limited for a time to allow for sand settlement and the elimination of a process called "sanding" where sand infiltrates the wellbore. In some wellbores, crevices in the rock formation are held open through materials called proppants. These proppants are pushed into tight fissionable areas where the proppants hold open the rock structure to allow trapped hydrocarbons to escape. If a choke schedule is not used, the proppants may be flushed from their respective locations in the wellbore strata, allowing overall wellbore rock to settle and progressively crush the remaining proppant, thus closing in the fluid carrying capability of the wellbore.

As will be understood, each wellbore is different in that the overall pressure experienced downhole is varied, the type of rock encountered is varied in the terms of density and potential to crack, the hydrostatic conditions, the size of the wellbore, the depth of the wellbore and other factors. Thus, a choke schedule takes all of these features into account to ensure that the previously completed wellbore operations are not compromised by starting of production too quickly.

Other values of interest include an overall emissions measure. This value is defined as quantity E. As explained above, the emissions measure may measure carbon dioxide or other emissions such as $CH_4$. In some embodiments, the amount and type of fluids produced at the wellhead, due to the choke schedule implementation, affects the overall emissions value, wherein some fluids may carry more carbon dioxide or methane components than others. This value may be calculated through the use of the emissions engine (SYMMETRY).

Components of the calculation system used in the analysis may vary. In one embodiment, four components are used. As will be understood, the four components may be performed by the same computing arrangement or may be calculated through separate computing arrangements. Computing arrangements may be a personal computer, a cloud-based computing arrangement, a super computer, or any other similar computing device. In the non-limiting example embodiment, the components are:

1) The clean-up engine—CUCP.
2) The emission engine—SYMMETRY.
3) A solver—the solver may use any suitable method for optimization. One such non-limiting embodiment may be an adaptive radial-basis function (RBF) method for expensive simulation-based optimization made available via a library defined as (AOL).
4) The last and critical element of the proposed framework concerns the formulation of the problem and the strategy to actually solve the multi-objective problem at hand, defined compactly as follows:

Max R (X)—maximum cleanup measure
Min T (X)—minimum overall time measure
Min E (X)—minimum environmental measure
s.t bounds on X and other stipulated nonlinear constraints G(X).

Here, in one example embodiment, the value X (which may be bounded per the above) represents the choke schedule in generic terms, and G(X) is the set of expensive simulation-based nonlinear constraints.

The present method demonstrates a superior and more efficacious scheme in comparison to the extension of the objective scheme of merely combining and solving for only maximum cleanup measure and minimum overall time measure. In one embodiment, the method provides for use of an emissions measure.

In one method, mathematical transforms are introduced to convert the raw metrics R, T and E, described above, into scaled measures Rm, Tm and Em. These mathematical transforms serve two purposes: The first purpose is to incorporate user specification based on utility of the desired output response. The second purpose is to normalize the data so that various measures can be readily combined.

Next a modified-objective scheme based on an exponential weighted sum is used to combine the measures Rm, Tm and Em into one quantity that serves as the objective value in a single-value expensive simulation-based optimization problem. In one non-limiting embodiment, a radial basis function (RBF) is used to optimize the posed problem. As will be understood, the radial basis function method may use scattered data interpolation capabilities for solution of complexly shaped domains.

Finally, a two-stage strategy is proposed in which the optimization is performed without restriction on the choke schedule X in the first step and the final desired state of the choke is obtained by optimization to manage stipulated constraints in the second step. The final state of the choke schedule may demand a fully open choke to allow fluids to directly flow into a production line, or a closed choke that may be preferable for offshore wells where connection to the production line may require some time to achieve.

It is notable that direct optimization with strict final choke pattern stipulation (open or closed) may impair optimization results over the three metrics of interest R, T, E. Hence, a two-stage strategy may be used effectively solve the stated problem.

The overall framework, presented below, with the components identified above (e.g., including CUCP, SYMMETRY and AOL) may be used for analysis as discussed with a hypothetical series of calculations shown below. The analysis highlights the use of transforms and validates various metrics, leading to the exponential weighted sum of measures (V3), as stated in FIG. 6. A comprehensive set of test cases are presented as examples.

FIG. 1 shows an example two-stage scheme choke schedule. The initial optimal schedule (to the left of 100) maximizes clean-up, minimizes time and $CO_2$ emissions, but ends at an intermediate choke setting. In step two, the choke schedule (to the right of 102) is extended to open (subject to constraints) without impairing the level of clean-up or the associated emissions level other than that resulting from the extended simulation period.

FIG. 2 shows the test results for an optimization case including the emissions measure. The first column provides results for the initial optimized schedule (the points to the left of 100 in FIG. 1), while the second column indicates how those quantities change over the second stage extension period to open the choke. The differences are given in the third column. Notably, the clean-up measure and time remain unchanged (rows 1 and 2). The emissions measure increases by 98 units (row 3 last column) due to the increased simulation time. The remaining rows similarly indicate how the stated quantities change over the two stages. As illustrated, the time to clean up remains the same. The time for simulation increases to 50 h, as per FIG. 1 (x axis).

Figure 4:
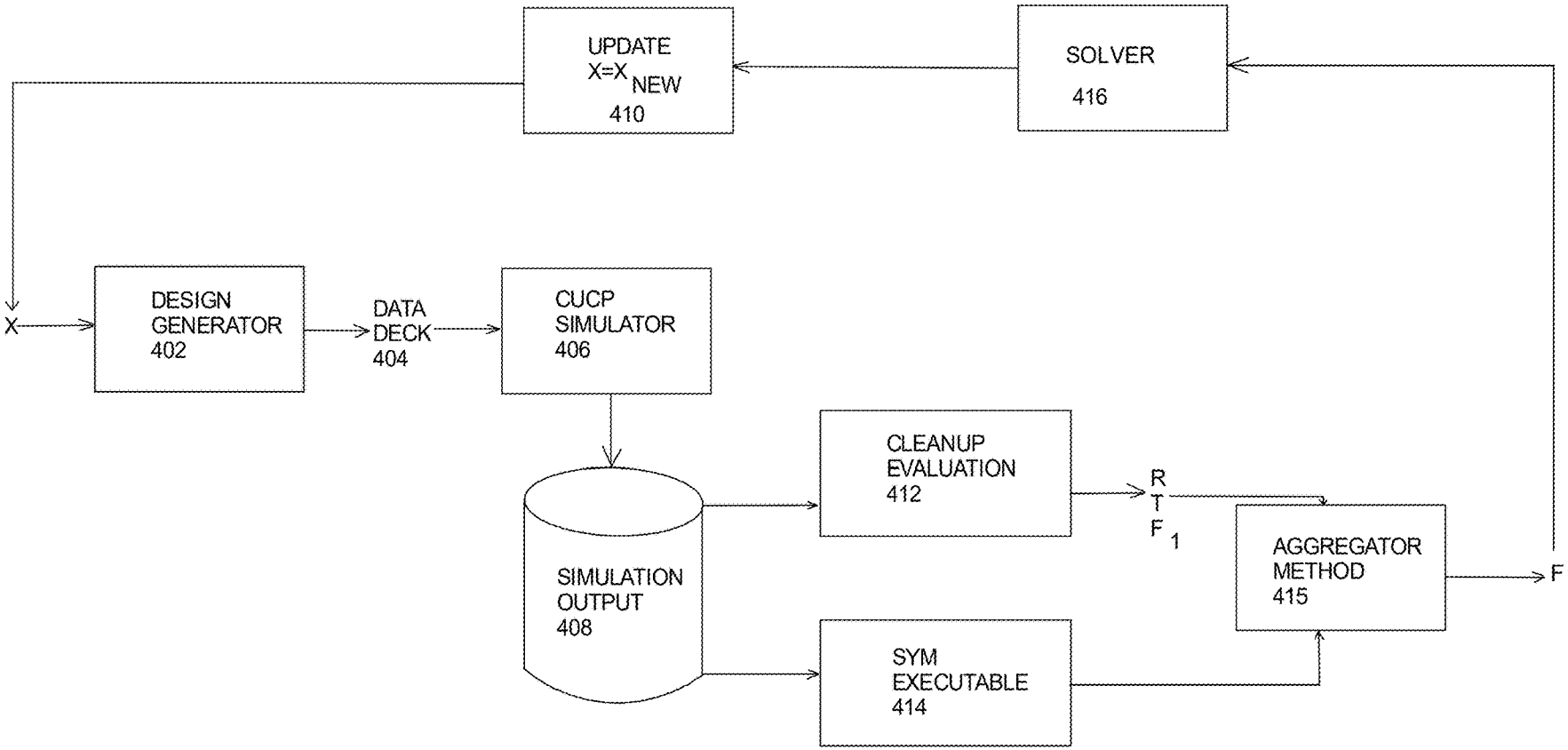
FIG. 4 is a workflow diagram of inputs and calculations in one example embodiment of the disclosure.

An example of a wellbore cleanup optimization with $CO_2$ emissions is illustrated in FIG. 4. A design generated by a design generator 402 is illustrated. The design generator 402 may add or subtract components necessary for completion of the project. In embodiments, the design generator 402 converts the parameterized control variable set X into the associated design elements that are inserted into the data deck 404 (e.g. as the expanded choke schedule with ramping and smoothing elements inserted). Choices of potential components may be input or selected from a data deck 404. The data deck 404, in one example embodiment, may be a centralized data base. After receiving data from the design generator 402 and the data deck 404, the CUCP simulator 406 may take the data and run calculations for the wellbore and produce a simulation output 408. The simulation output 408 is output into both a cleanup evaluation algorithm 412 and a SYM executable 414 where $CO_2$ emissions are calculated. As will be understood, the cleanup evaluation algorithm 412 calculates all values such as efficiency of cleanup for the arrangement provided by the design generator 402. These values may also include time for completion of the project. An aggregator method 415 is performed with the data from the cleanup evaluation algorithm 412 and the SYM executable 414. The results are generated (the combined objective value) and given to the SOLVER in 416. In one embodiment, the SOLVER is an adaptive radial basis function scheme. Other types of suitable solvers may be used. The method then progresses to 410 which uses another step in the choke progression which then progresses back to the design generator 402.

Referring to the solution comparison chart below, and the metrics as listed in FIG. 6, values for the method are illustrated for each of the solutions. For example, Table 1 illustrates V1 values that are used in the solution comparison. Table 2 illustrates V2 values that are used in the solution comparison. Table 3 illustrates V3 values that are used in the solution comparison.

SOLUTION COMPARISON

| Optimize Metric | V1 | V2 | V3 |
|---|---|---|---|
| Clean Up % | 99.796 | 96.917 | 99.275 |
| Time T (Days) | 1.1125 | 0.6458 | 0.925 |
| CO2 Emissions | 190.96 | 70.572 | 143.35 |
| Cleanup Measure | 9.9852 | 9.7287 | 9.9458 |
| Time Measure | 7.6767 | 9.3803 | 8.5661 |
| Emissions Measure Em | 4.0254 | 9.3751 | 6.8679 |

-continued

SOLUTION COMPARISON

| Optimize Metric | V1 | V2 | V3 |
|---|---|---|---|
| Metric V1 | 100.38 | 98.396 | 100.04 |
| Metric V2 | 21.687 | 28.484 | 25.38 |
| Metric V3 | 27.257 | 28.768 | 28.491 |
| Metric V4 | 6.411 | .09209 | 3.4452 |
| Sample Index | 199 | 156 | 85 |

TABLE 1

| Optimize Metric | V1 | V2 | V3 | V4 |
|---|---|---|---|---|
| Clean Up % | 99.796 | 89.080 | 98.976 | 89.080 |
| Time T (Days) | 1.1125 | 0.6958 | 0.8167 | 0.6958 |
| CO2 Emissions | 190.96 | 89.352 | 134.1 | 89.352 |
| Cleanup Measure | 9.9852 | 8.3573 | 9.9219 | 8.3573 |
| Time Measure | 7.6767 | 9.2716 | 8.9462 | 9.2716 |
| Emissions Measure Em | 4.0254 | 8.9828 | 7.3433 | 8.9828 |
| Metric V1 | 100.38 | 90.167 | 99.799 | 90.167 |
| Metric V2 | 21.687 | 26.612 | 26.211 | 26.612 |
| Metric V3 | 27.257 | 22.72 | 28.710 | 22.72 |
| Metric V4 | 6.411 | 2.0649 | 2.8591 | 2.0649 |
| Sample Index | 199 | 13 | 92 | 13 |

TABLE 2

| Optimize Metric | V1 | V2 | V3 | V4 |
|---|---|---|---|---|
| Clean Up % | 99.868 | 96.917 | 99.12 | 96.917 |
| Time T (Days) | 1.2875 | 0.6458 | 0.8708 | 0.6458 |
| CO2 Emissions | 210.05 | 70.572 | 99.557 | 70.572 |
| Cleanup Measure | 9.9905 | 9.7287 | 9.9335 | 9.7287 |
| Time Measure | 6.5765 | 9.3803 | 8.7675 | 9.3803 |
| Emissions Measure Em | 2.9524 | 9.3751 | 8.7038 | 9.3751 |
| Metric V1 | 100.4 | 98.396 | 100.2 | 98.396 |
| Metric V2 | 19.519 | 28.484 | 27.405 | 28.484 |
| Metric V3 | 26.479 | 28.768 | 29.225 | 28.768 |
| Metric V4 | 7.8351 | 0.9209 | 1.7899 | 0.9209 |
| Sample Index | 20 | 156 | 145 | 156 |

TABLE 3

| Optimize Metric | V1 | V2 | V3 | V4 |
|---|---|---|---|---|
| Clean Up % | 99.754 | 89.08 | 99.275 | 89.08 |
| Time T (Days) | 1.5292 | 0.6958 | 0.925 | 0.6958 |
| CO2 Emissions | 163.1 | 89.353 | 143.35 | 89.352 |
| Cleanup Measure | 9.9822 | 8.3573 | 9.9458 | 8.3573 |
| Time Measure | 4.7765 | 9.2716 | 8.5661 | 9.2716 |
| Emissions Measure Em | 5.7371 | 8.9828 | 6.8679 | 8.9828 |
| Metric V1 | 100.41 | 90.167 | 100.04 | 90.167 |
| Metric V2 | 20.496 | 26.612 | 25.38 | 26.612 |
| Metric V3 | 26.803 | 22.720 | 28.491 | 22.720 |
| Metric V4 | 6.7422 | 2.0649 | 3.4452 | 2.0649 |
| Sample Index | 23 | 13 | 85 | 13 |

Figure 5:
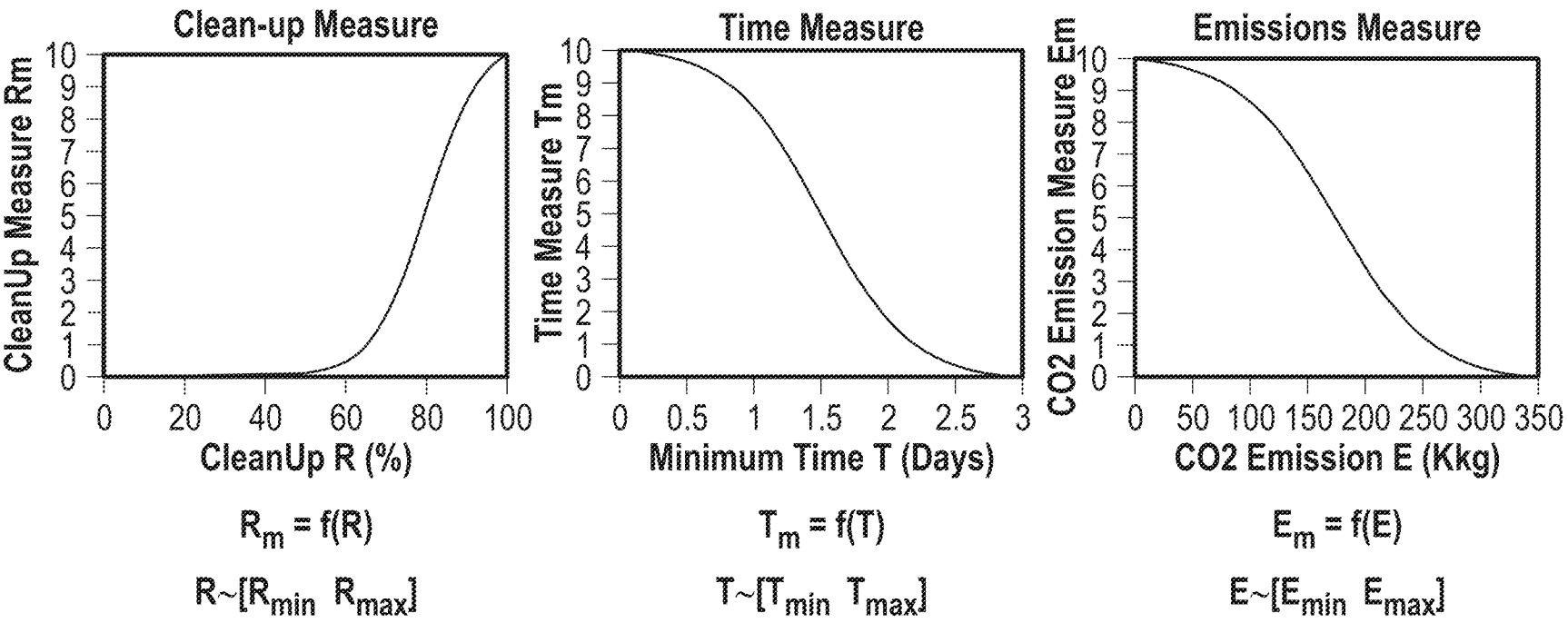
FIG. 5 shows metric value equations for use in the method operations of FIG. 3.

Referring to FIG. 5, the metrics for cleanup, time, and emissions are illustrated. The plots show the variation of each measure on the x-axis and the normalized response on the y-axis. These transforms can be tuned (or designed) to give the required response indicative of the decision maker's preferences. The operators; therefore, may choose configurations where one metric is valued higher than another. For example, if a minimum of carbon dioxide emissions is desired, the metric illustrates when such a condition exists. As will be understood, each of the metrics are individually predicated upon the type of configuration that is chosen for the field. Thus, if the overall results are still not acceptable, additional components or a varied configuration may be used to enhance the individual metrics that are calculated.

Referring to FIG. 6, example values of different metrics used for calculation purposes are presented. As will be understood, such metric formulas are for example purposes only. These formulas are used for the calculation of Metric V1, Metric V2, Metric V3 and Metric V4, as provided in the solution comparison and Tables 1, 2 and 3 listed above.

In embodiments, a modified time transform may be used to penalize solutions near final simulation time. As will be understood, different values may be calculated according to a choke schedule. In embodiments, a near closed choke configuration, a near open choke configuration and a no restriction choke configuration may be chosen for calculation. Thus, for the choke schedule chosen, the best configuration for efficiency of cleanup with minimized emissions may be found.

In embodiments, a two-stage optimization strategy may be used for selection of the best solution. The choke schedule may be chosen to provide an open schedule or a closed schedule. Per the opening or closing in the choke schedule, values of the metrics, calculated above, may indicate which potential arrangement or metric may be prioritized.

Figure 3:
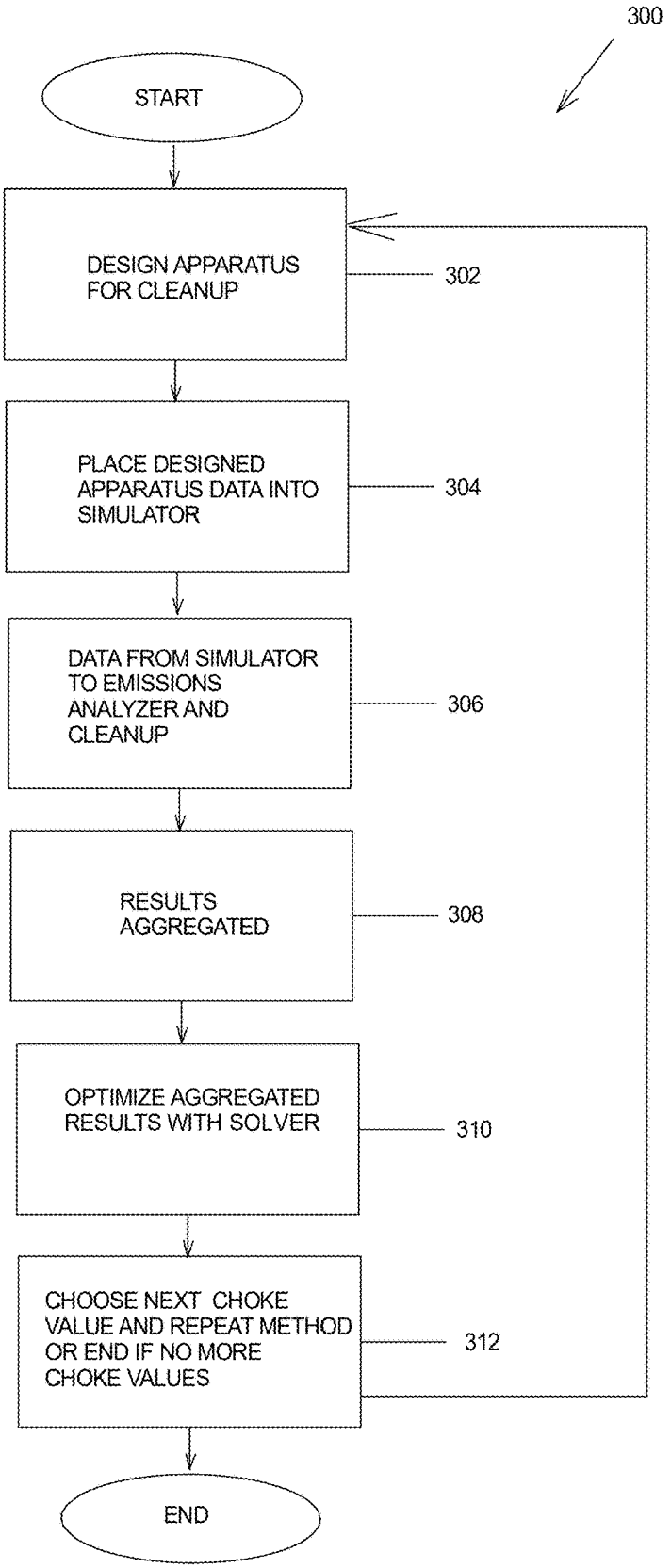
FIG. 3 is a flowchart for method operations for a two-stage operation for wellbore cleanup using an emissions measure.

Referring to FIG. 3, a method 300 for a two-stage multi-objective optimization scheme for wellbore cleanup with an emission measure is illustrated. At 302, an arrangement is designed for cleanup of a wellbore. In embodiments, components of the arrangement may be chosen by a computer and/or operator. At 304, the arrangement developed at 302 is placed into a simulator to determine the cleanup capability of the arrangement chosen, thereby producing a simulator output. At 306, the simulator output is fed into evaluation process, wherein the simulator output is input into a cleanup evaluator and an emissions engine. At 308, values from the cleanup evaluator and the emissions engine are aggregated into an aggregator to achieve aggregator results. The aggregator results, at 310 are fed into a solver to optimize results. In one non-limiting embodiment, a radial basis function method may be used to optimize the results. At 312, the method continues with using a choke schedule to update conditions on flow or no flow conditions with the method returning to step 300 until the choke schedule timeline is finished.

The method 300 disclosed above may be accomplished through a computing arrangement. The computing arrangement may be, for example, a personal computer, a cloud-based computer or other arrangement. The method may be incorporated into a non-volatile memory arrangement. The non-volatile memory arrangement may be used to load instructions onto a computing arrangement. In some embodiments, the databases may be used for help in selection of components. These databases may be linked, for example, through an internet connection, in one non-limiting embodiment.

Aspects of the disclosure may be performed through use of not only a pre-programmed set of calculations but also through the use of artificial intelligence techniques. In some embodiments, training sets of data may be used to enable the artificial intelligence to select components for wellbore cleanup. After successive iterative runs, different possible solutions may be rejected by the artificial intelligence because previous repetitive calculations continuously indicate that selections of some equipment does not yield a beneficial result. In other embodiments, it may be learned by the artificial intelligence that use of some types of equipment or sets of equipment produce more positive results and thus, the overall results are quickly achieved. These techniques; therefore, provide a computational efficiency that non-artificial intelligence based systems cannot achieve. As the overall number of calculations performed may be large; artificial intelligence systems will allow for sifting of large amounts of data, allowing a preferred choice to be immediately made. For example, as described above, a choke schedule is chosen and a hypothetical system is run under that choke schedule, and the total efficiency of removal of materials as well as time and environmental measures are taken into account. As discussed; however, alterations of the types of components used for wellbore cleanup may be made successively, thereby requiring more calculations. The number of potential configurations may be large. To enable the absolute best alternative to be chosen, the number of iterations run may be significant if the overall reduction in the emissions is to be achieved. Thus, instead of merely presenting data for later analysis, an automated intelligence system can be programmed to remove the need for such analysis and provide a desired answer quickly.

Embodiments presented in the claims are presented next. The embodiments disclosed should not be considered limiting. In one example embodiment, a method is disclosed. The method may comprise designing an arrangement for cleanup of a wellbore. The method may further comprise placing data pertaining to the arrangement for cleanup of the wellbore into a simulator designed to determine a simulator output for the arrangement. The method may further comprise feeding the simulator output for the arrangement into both an emissions engine and a cleanup evaluator to achieve an emissions engine output and a cleanup evaluator output. The method may further comprise inputting the cleanup evaluator output and the emissions engine output into an aggregator to achieve an aggregated solution. The method may further comprise optimizing the aggregated solution to achieve optimized results. The method may further comprise performing the method repetitively for all times related to a choke schedule.

In another example embodiment, the method may be performed wherein the arrangement includes at least one pump.

In another example embodiment, the method may be performed wherein the designing of the arrangement is performed by a computer.

In another example embodiment, the method may be performed wherein the designing of the arrangement for cleanup of the wellbore is performed by an operator.

In another example embodiment, the method may be performed wherein the optimizing the aggregated solution is through a radial basis function.

In another example embodiment, the method may be performed wherein the choke schedule determines a flow from the wellbore during cleanup activities.

In another example embodiment, the method may be performed wherein the choke schedule has at least one of an open status for flow from the wellbore, a closed status for flow from the wellbore and a free flow status for flow from the wellbore.

In another example embodiment, an article of manufacture having a non-volatile memory configured to receive and store a set of instructions to be performed on a computing device, the set of instructions including a method comprising designing an arrangement for cleanup of a wellbore. The method performed may also comprise placing data pertaining to the arrangement for cleanup of the wellbore into a simulator designed to determine a simulator output for the arrangement. The method performed may also comprise feeding the simulator output for the arrangement into both an emissions engine and a cleanup evaluator to achieve an emissions engine output and a cleanup evaluator output. The method performed may also comprise inputting the cleanup evaluator output and the emissions engine output into an aggregator to achieve an aggregated solution. The method performed may also comprise optimizing the aggregated solution to achieve optimized results. The method performed may also comprise performing the method repetitively for all times related to a choke schedule.

In another example, the article of manufacture may be configured wherein the method contained on the non-volatile memory wherein the step of the designing of the arrangement for cleanup of the wellbore is performed by an operator.

In another example, the article of manufacture may be configured wherein the method contained on the non-volatile memory specifies that the optimizing the aggregated solution is through a radial basis function.

In another example, the article of manufacture may be configured wherein the method on the non-volatile memory specifies that the choke schedule determines a flow from the wellbore during cleanup activities.

In another example, the article of manufacture may be configured wherein the method on the non-volatile memory specifies that the choke schedule has at least one of an open status for flow from the wellbore, a closed status for flow from the wellbore and a free flow status for flow from the wellbore.

In another example embodiment, a method for optimizing a cleanup of a wellbore is disclosed. The method may also comprise designing a mechanical arrangement configured to perform the cleanup of the wellbore, the mechanical arrangement having performance data. The method may also comprise placing the performance data pertaining to the arrangement for the cleanup of the wellbore into a simulator and determining a simulator output for the arrangement. The method may also comprise feeding the simulator output for the arrangement into both an emissions engine and a cleanup evaluator to achieve an emissions engine output and a cleanup evaluator output. The method may also comprise inputting the cleanup evaluator output and the emissions engine output into an aggregator to achieve an aggregated solution. The method may also comprise optimizing the aggregated solution through use of a radial basis function to achieve optimized results. The method may also comprise performing the method repetitively for all times related to a choke schedule as well as for different mechanical arrangements, wherein the choke schedule is determined for safe operations at the wellhead and in the wellbore.

In another example embodiment, the method may be performed wherein the arrangement includes at least one of a pump and a flare system.

In another example embodiment, the method may be performed wherein the designing of the arrangement is performed by a computer equipped with artificial intelligence.

In another example embodiment, the method may be performed wherein the choke schedule determines a flow from the wellbore over a time interval during cleanup activities.

In another example embodiment, the method may be performed wherein the choke schedule has at least one of an open status for flow from the wellbore, a closed status for flow from the wellbore and a free flow status for flow from the wellbore.

In another example embodiment, the method may be performed wherein method is performed on one of a personal computer, a cloud-based computer and a mobile computer.

In another example embodiment, the method may be performed wherein the differing mechanical arrangements are chosen with respect to an emissions measure.

In another example embodiment, the method may be performed wherein the emissions measure is a total production of carbon dioxide emitted during the cleanup process.

In another example embodiment, the method may be performed wherein the arrangement includes at least one of a pump and a burner system.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method, comprising:

designing a mechanical arrangement for cleanup of a wellbore;

placing data pertaining to the arrangement for cleanup of the wellbore into a simulator designed to determine a simulator output for the mechanical arrangement;

feeding the simulator output for the mechanical arrangement into both an emissions engine and a cleanup evaluator to achieve an emissions engine output and a cleanup evaluator output;

inputting the cleanup evaluator output and the emissions engine output into an aggregator to achieve an aggregated solution;

optimizing the aggregated solution to achieve optimized results;

performing the method repetitively for all times related to a choke schedule; and performing a cleanup operation in the wellbore with the optimized aggregated solution corresponding to each time of the choke schedule of the method.

2. The method according to claim 1, wherein the mechanical arrangement includes at least one pump.

3. The method according to claim 1, wherein the designing of the mechanical arrangement is performed by a computer.

4. The method according to claim 1, wherein the designing of the mechanical arrangement for cleanup of the wellbore is performed by an operator.

5. The method according to claim 1, wherein the optimizing the aggregated solution is through a radial basis function.

6. The method according to claim 1, wherein the choke schedule determines a flow from the wellbore during cleanup activities.

7. The method according to claim 6, wherein the choke schedule has at least one of: an open status for flow from the wellbore, a closed status for flow from the wellbore, or a free flow status for flow from the wellbore.

8. An article of manufacture having a non-volatile memory configured to receive and store a set of instructions to be performed on a computing device, the set of instructions including a method comprising:

designing a mechanical arrangement for cleanup of a wellbore;

placing data pertaining to the mechanical arrangement for cleanup of the wellbore into a simulator designed to determine a simulator output for the mechanical arrangement;

feeding the simulator output for the mechanical arrangement into both an emissions engine and a cleanup evaluator to achieve an emissions engine output and a cleanup evaluator output;

inputting the cleanup evaluator output and the emissions engine output into an aggregator to achieve an aggregated solution;

optimizing the aggregated solution to achieve optimized results;

performing the method repetitively for all times related to a choke schedule; and performing a cleanup operation in the wellbore with the optimized aggregated solution corresponding to each time of the choke schedule of the method.

9. The article of manufacture according to claim 8, wherein the designing of the arrangement for cleanup of the wellbore is performed by an operator.

10. The article of manufacture according to claim 8, wherein the method contained on the non-volatile memory specifies that the optimizing the aggregated solution is through a radial basis function.

11. The article of manufacture according to claim 8, wherein the method on the non- volatile memory specifies that the choke schedule determines a flow from the wellbore during cleanup activities.

12. The article of manufacture according to claim 11, wherein the method on the non-volatile memory specifies that the choke schedule has at least one of an open status for flow from the wellbore, a closed status for flow from the wellbore, and a free flow status for flow from the wellbore.

* * * * *